US005839803A

United States Patent [19]

Lizell

[11] Patent Number: 5,839,803

[45] Date of Patent: Nov. 24, 1998

[54] LOCKING SYSTEM FOR MODULAR LATERAL AND VERTICAL STACKING FILES

[76] Inventor: Anthony R. Lizell, 108 Old Oak Tree Rd., Lansdale, Pa. 19446

[21] Appl. No.: 730,055

[22] Filed: Oct. 15, 1996

[51] Int. Cl.[6] ..... A47B 87/00

[52] U.S. Cl. ..... 312/107.5; 312/221

[58] Field of Search ..... 312/107.5, 107, 312/108, 215, 216, 217, 219, 222; 70/78, 85

[56] References Cited

U.S. PATENT DOCUMENTS

| | | | |
|---|---|---|---|
| 3,404,929 | 10/1968 | Wright et al. | 312/216 |
| 3,764,190 | 10/1973 | Anderson | 312/219 X |
| 4,609,233 | 9/1986 | Walla | 312/219 |
| 4,838,624 | 6/1989 | Walla | 312/221 |
| 4,925,257 | 5/1990 | Frederiksen et al. | 312/221 |
| 4,955,672 | 9/1990 | Pham | 312/107.5 |

OTHER PUBLICATIONS

Stackable File Cabinets—Levenger—©1994 Levenger Company (FTS—TF500 Mar. 3, 1994), Brochure.

*Primary Examiner*—Peter R. Brown
*Assistant Examiner*—James O. Hansen
*Attorney, Agent, or Firm*—Michael D. Bednarek; Kilpatrick Stockton LLP

[57] ABSTRACT

A lock bar assembly for use in a stacking file of the type separate first and second drawer modules that are connected to one another to form a cabinet. Each drawer module includes at least one drawer that is selectively slidable between an open position and a closed position. A snap-on connector allows two or more distinct lock bar portions to function as a single integrated lock bar for preventing simultaneous movement of the first and second drawers from their closed position to their open position. The snap-on connector simplifies connection of the lock bar portions.

21 Claims, 9 Drawing Sheets

LOCKING SYSTEM FOR MODULAR LATERAL AND VERTICAL STACKING FILES

BACKGROUND OF THE INVENTION

1. Field of the Invention

The present invention relates to a locking system for a stacking lateral or vertical file of the type having separate first and second drawer modules that are connected to one another to form a cabinet. The invention is more particularly directed to a simple easy to use snap-on connector that simplifies connection of distinct lock bar portions so that the lock bar assembly of the modular unit functions as an integrated assembly.

2. Background Art

It is known to provide structure to prevent opening of more than one drawer at a time on a piece of furniture and to use such structure to allow locking of the entire file with a single lock mechanism. In this way, the structure serves to prevent the cabinet from becoming front heavy and tipping as might potentially cause injury to the user and also serves to protect the file contents.

U.S. Pat. No. 3,404,929, to Wright et al, discloses such a safeguard in the context of a cabinet with a plurality of vertically arranged drawers. Each drawer carries a plate that, upon the drawer being opened, deflects a lug on a translatable locking bar to reposition the locking bar so that the locking bar prevents opening of any of the other drawers.

U.S. Pat. No. 4,609,233 and 4,838,624 to Walla and U.S. Pat. No. 4,925,257 to Frederiksen disclose discloses various furniture locking systems based on the concept first described by Wright.

FIGS. 1 and 2 shows a conventional system of the type shown by Walla. As shown and described therein, each drawer 14, 214, is substantially rectangular and carries on its sidewall 22, 222 a ramp plate 24, 224 that cooperates with a vertically disposed, sliding locking bar 26, 226 formed of strap metal. The bars 26, 226 are carried by the cabinet 12, 212 and situated adjacent the sidewalls 22, 222 carrying the ramp plates 24, 224. Each locking bar 26, 226 has integral cylindrical lugs 28, 228 projecting laterally towards each of the ramp plates 24, 224.

With the drawers 14, 214 in a closed position, the lugs 28, 228 each align adjacent the front edge of one of the plates 24, 224 as illustrated in FIG. 1. Each plate 24, 224 has a substantially rectangular configuration and defines an inclined guide slot 30, 230 having a width sufficient to accept the lugs 28, 228. Each slot 30, 230 is defined by first and second opposed ramp surfaces 32, 232 and 34, 234 respectively. It can be seen that as one of the drawers 14, 214 is withdrawn, the lug 28, 228 associated with that drawer will be urged upwardly by the first ramp surface 32, effecting vertical upward shifting of the locking bar 26, 226. This action misaligns the lugs 28, 228 and slots 30, 230 on the remainder of the drawers 14, 214 and situates the lugs 28, 228 in front of a vertical blocking surface 36, 236 on the forward portion of the ramp plates 24, 224. The blocking surface 36, 236 on each ramp plate 24, 224 engages the respective lug 28, 228 to prohibit withdrawal of each of the other drawers 14, 214. This arrangement forbids removal of more than one drawer at a time to prevent inadvertent tipping of the cabinet. Upon closing the one drawer, the lug adjacent the plate 24, 224 on the one drawer 28, 228 encounters the second ramp surface 34, 234 and translates the locking bar 26, 226 vertically downward into a position so that any of the drawers 14, 214 can be opened.

To assist guiding of the lugs 28, 228 along the ramp plates 24, 224 the leading edge 38, 238 of the first ramp surface 32, 232 is rounded. The rounded edge 38, 238 deflects the lug 28,228 properly onto the first ramp surface 32. The leading edge 40, 240 at the second ramp surface 34, 234 is similarly contoured to assist entry of the lug 28, 228 as the drawer 14, 214 is closed. Further, a beveled surface 42, 242 is provided at the ends of the ramp plate 24, 224 to prevent the free ends of the lugs 28, 228 from binding as the lugs 28 pass over either end of the ramp plate 24, 224.

Thus, the lugs 28,128,228 define translatable locking bolts that may be disposed selectively on one of the support 26,126,226 and the drawer intended to be locked with the cooperating ramp plate mounted on the other of the drawer or support.

The known furniture locking systems based on the concept first described by Wright are suitable for one-piece multi-drawer cabinets. These locking systems are not, however, readily adaptable to modular-type filing cabinets that have come into vogue. A typical modular cabinet system includes a base, one or more drawer modules and a top. Each drawer module must be completely separate and distinct from other modules so that the modules can be stacked and attached to one another in any desired sequence. As a consequence, it is not practical to provide a single sliding locking bar along the sidewall of the assembled modular unit.

To address this problem, known drawer modules include discrete vertically disposed, sliding locking bar portions. Each portion is carried by its drawer module and situated adjacent the sidewalls carrying the ramp plates. The locking bar portions include integral cylindrical lugs projecting laterally towards each of the ramp plates or some other mechanism for preventing more than one drawer from being opened at any one time.

A problem results, however, because the locking bar portions must slide and otherwise operate as a unit. In the past this has required the attachment of a splicer to connect adjacent locking bar portions. FIGS. 11–11B shows one known splicer arrangement. The present inventor has found that known splicing arrangements are extremely difficult to assemble, even for a professional. This difficulty can lead to customer dissatisfaction and loss of business. One company cautions its customers not to become discouraged if it takes a few trials to lock the splicer in place. This suggests that there is no possibility of finding a way of easing assembly of the locking system.

SUMMARY OF THE INVENTION

The present inventor has found that splicing adjacent locking bar portions in drawer modules is the most difficult assembly step for most customers. Moreover, it is believed that the difficulty in splicing adjacent locking bar portions in drawer modules is one of the principal obstacles to consumer acceptance of unassembled modular drawer units. For these reasons, it is an object of the present invention to provide a modular stacking lateral or vertical file of the type having separate first and second drawer modules that are connected to one another to form a cabinet that has an easy to assemble lock bar assembly.

Another object of the invention is to provide a snap-on connector that simplifies connection of two or more distinct lock bar portions and allows the lock bar portions to function as a single integrated lock bar for preventing simultaneous movement of the first and second drawers from their closed position to their open position.

These and other objects are achieved by the present invention. In particular, the present invention provides a modular stacking file that includes at least two drawer modules. Each drawer module includes a cabinet portion and at least one drawer. The drawer is selectively slidable relative to the cabinet portion between an open position and a closed position. The drawer modules also include lock bar portions that have at least one transverse protrusion and means for mounting the lock bar portion to the cabinet for translatory movement relative to the cabinet in first and second opposite directions between first and second positions.

Means, such as pegs and holes, are provided for aligning and connecting the drawer modules such that the lock bar portion of the first drawer module is aligned with the lock bar portion of the second drawer module.

The lateral or vertical file also includes a connecting plate having two openings. Each opening is adapted to receive one of the protrusions formed on the lock bar portion so that the connecting plate can be secured to both the lock bar portion of the first drawer module and the lock bar portion of the second drawer module so at to join the respective lock bar portions as a single unitary lock bar assembly that moves as one piece.

Preferably, the lateral or vertical stacking file has top and base and each module can be connected to either top or base. In addition, the protrusions are preferably studs located proximate an end of the lock bar portion and the studs may include an expanded head portion. The connecting plate preferably includes rubber washers secured in the circular openings. The rubber washers should have a protrusion receiving opening that has a predetermined diameter that is less than the outer dimension of the protrusion so that the washer must be compressed to receive the protrusion.

The present invention also relates to an improved system for connecting the reciprocative slide bars of adjacent drawer modules that includes least one transverse protrusion provided on each slide bar and a connecting plate having two openings. Each opening in the connecting plate is adapted to receive one of the protrusions formed on the slide bar so that the connecting plate can be secured to the slide bars of the adjacent drawer modules so at to join the respective slide bars as a single unitary lock bar assembly that moves as one piece.

BRIEF DESCRIPTION OF THE DRAWINGS

FIG. 4A shows an exploded perspective view of the stacking lateral file of FIG. 3A including hardware used to assemble the file.

DETAILED DESCRIPTION OF THE DRAWINGS

The present invention is specifically directed to a modular stacking lateral or vertical file. Such modular units have been known for some time. In essence, the manufacturer supplies modular components, typically including a file base, a top panel and one or more drawer modules. The drawer modules typically have a standard size so that by combining two or more drawer modules, a customer can design a stacking lateral or vertical file of any desired height. In addition, it is common to include at least two distinct types of drawer modules. For example, a manufacturer might provide a single drawer file box for holding full size files and also provide a multidrawer file box for holding smaller items. By providing such files, a wide variety of stacking lateral or vertical file configurations can be obtained.

To better appreciate the concept of the modular stacking lateral or vertical file, it is useful to consider the typical assembly process for a stacking lateral or vertical file. To this end, the assembly of a modular stacking lateral or vertical file will be described hereinafter with reference to FIGS. 3–14.

Figure 2:
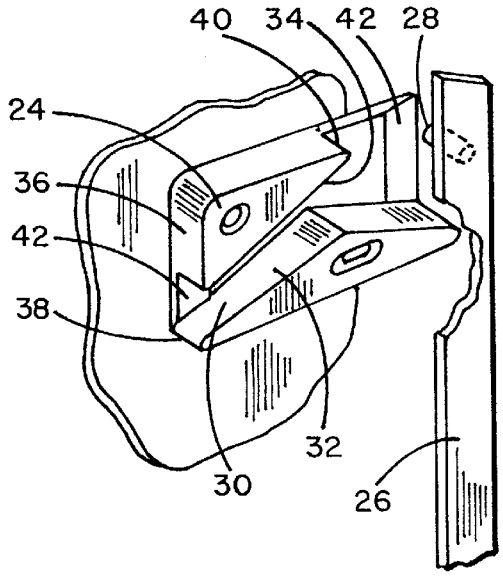
FIG. 2 PRIOR ART
FIG. 2 is a fragmentary perspective view of the coacting structure on the slide bar and drawers in the prior art locking system of FIG. 2.
Figure 1:
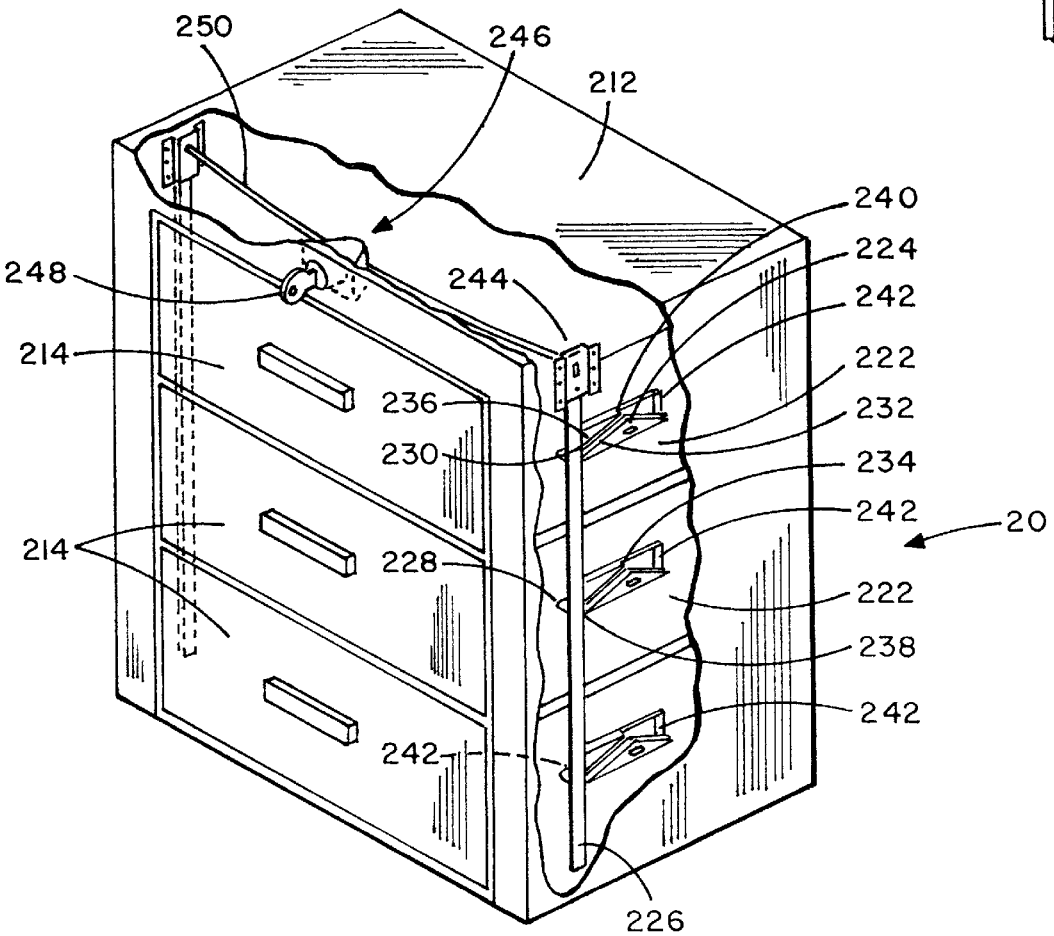
FIG. 1 PRIOR ART
FIG. 1 is a perspective view of a prior art locking system.
Figure 3:
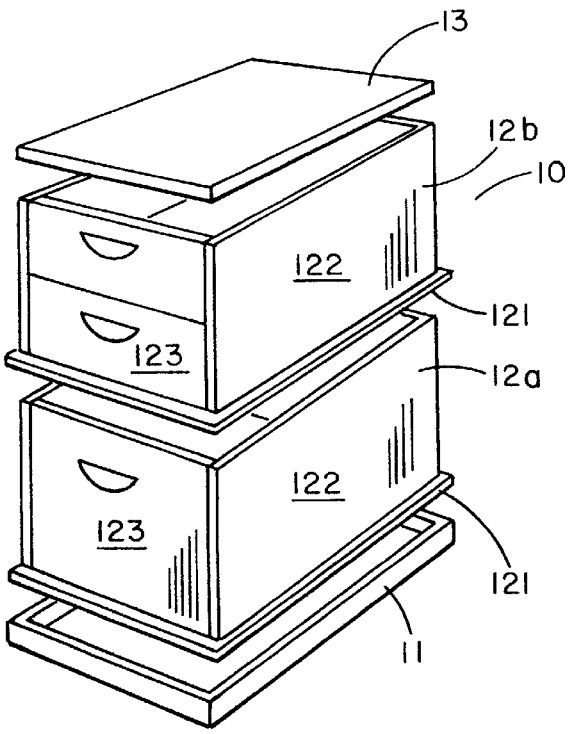
FIG. 3 shows a stacking vertical file according to the present invention in perspective.
Figure 3A:
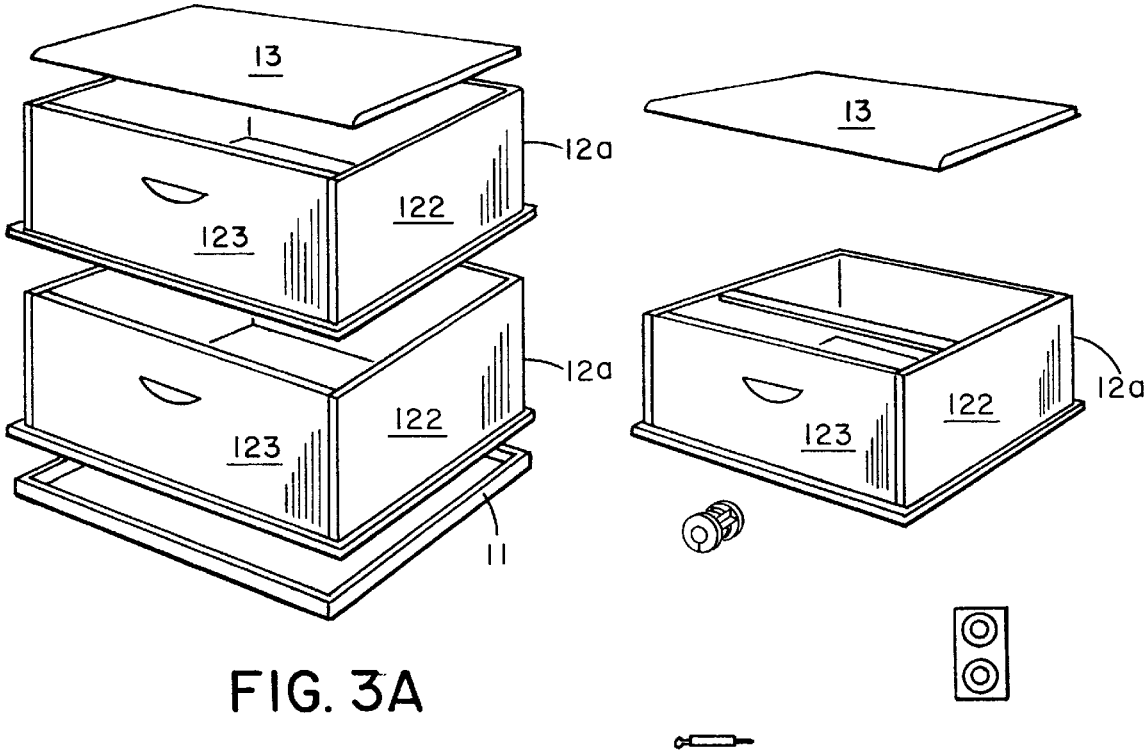
FIG. 3A shows a stacking lateral file according to the present invention in perspective.
Figure 4A:
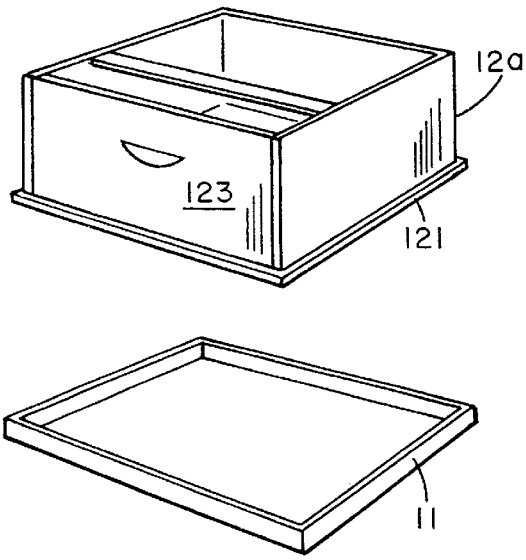
Figure 3B:
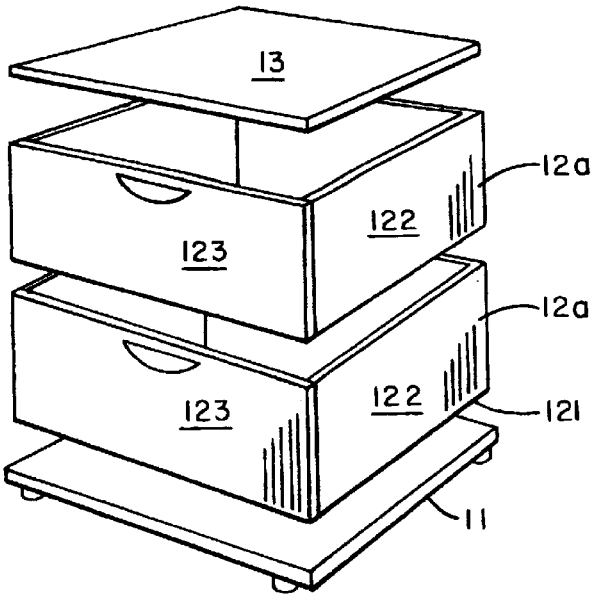
FIG. 3B shows another stacking lateral file according to the present invention in perspective.

To begin with, FIGS. 3–3B show partially exploded perspective views of several styles of stacking files according to the present invention. In particular, FIG. 3 shows a stacking vertical file, FIG. 3A shows a stacking lateral file and FIG. 3B shows another stacking lateral file. As shown in these figures, the stacking file includes a file base 11, two drawer modules 12*a*, 12*b* and a top panel 13. As is evident from the drawing, different types of drawer modules 12*a*, 12*b* are used. Specifically, in the illustrated embodiment, the lower drawer module 12*a* is a single drawer file box. The upper drawer module 12*b* is a two drawer file box. In the illustrated embodiment, each drawer module includes a drawer base 121, drawer sidewalls 122 and a drawer unit 123. Drawer modules 12*a*, 12*b* do not include a top panel. This is because, when assembled, the drawer base 121 or bottom panel acts as the top panel of the drawer module on which it sits. A separate top panel 13 is provided on the uppermost drawer module 12*b*.

Figure 4:
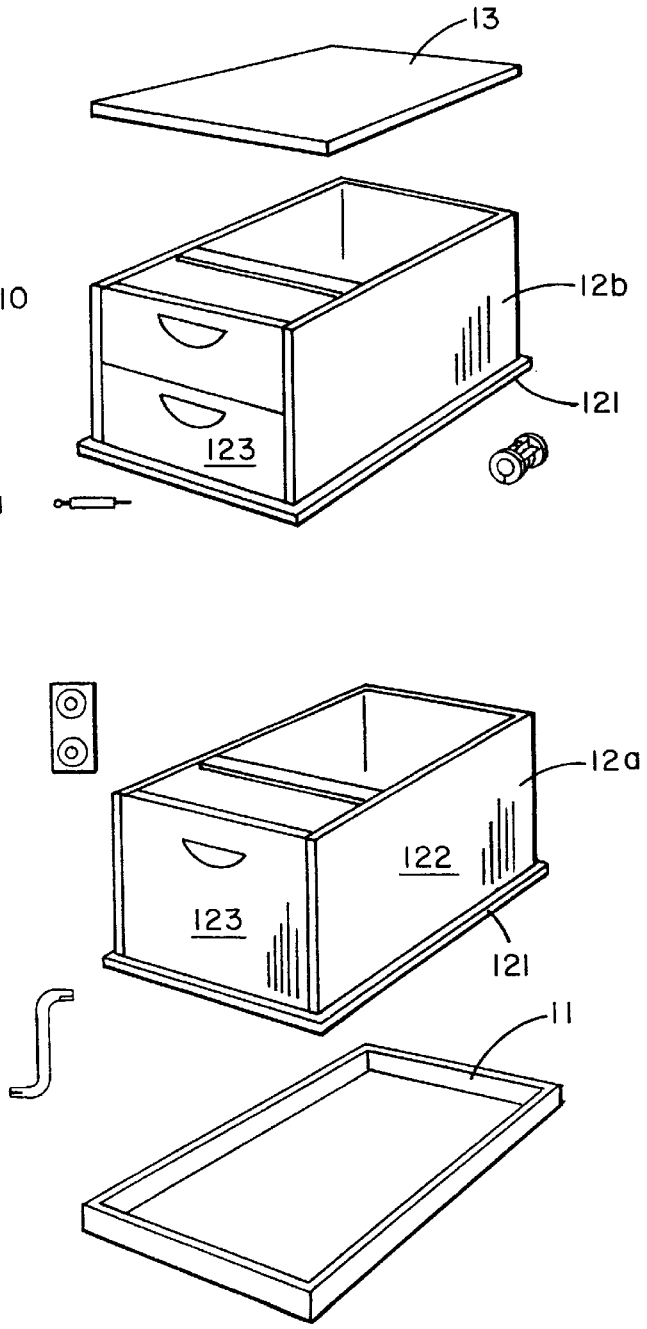
FIG. 4A shows an exploded perspective view of the stacking vertical file of FIG. 3, including hardware used to assemble the file.
FIG. 4B shows an exploded perspective view of the stacking lateral file of FIG. 3B, including hardware used to assemble the file.
Figure 4B:
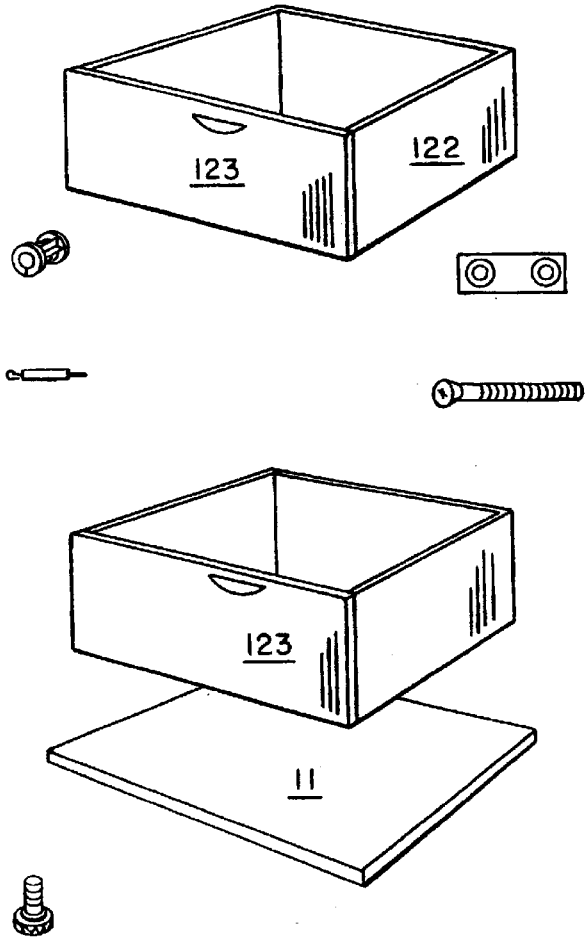

As best shown in the fully exploded views of FIGS. 4–4B, a typical modular stacking file unit 10 will include the previously described file base 11, drawer modules 12*a*, 12*b* and top panel 13 and will also include a supply of locking nuts, locking screws and a snap-on connector plate 15 according to the present invention.

Figure 6:
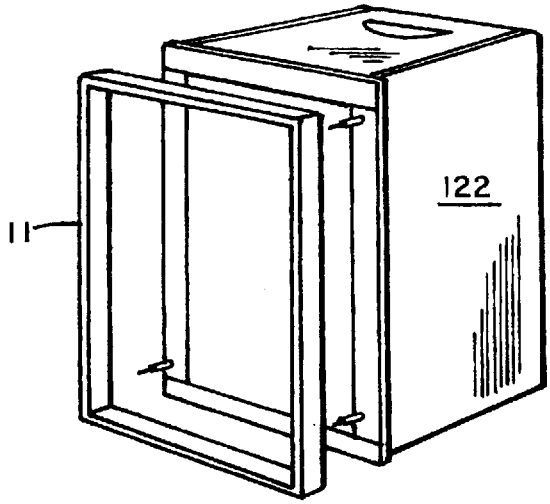
FIG. 6 shows a second assembly step according to the present invention.
Figure 5:
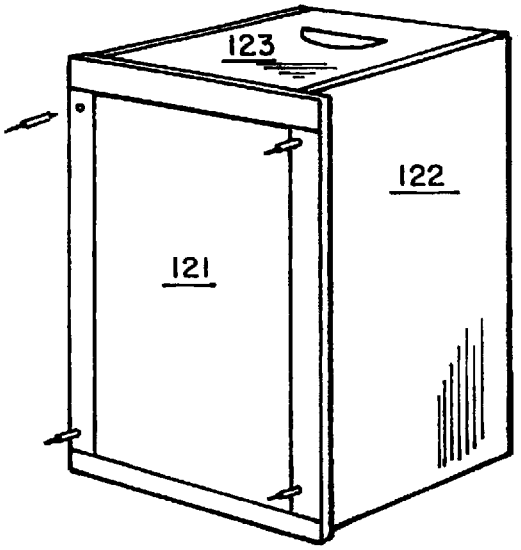
FIG. 5 a first assembly step according to the present invention.
Figure 8:
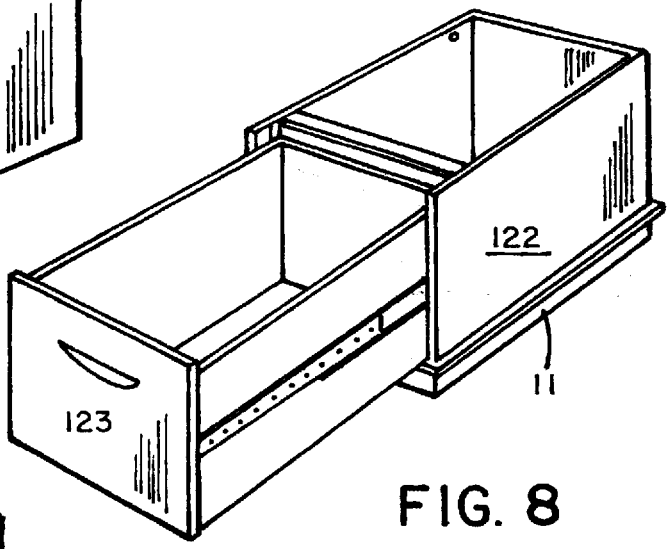
FIG. 8 shows a fourth assembly step according to the present invention.
Figure 7:
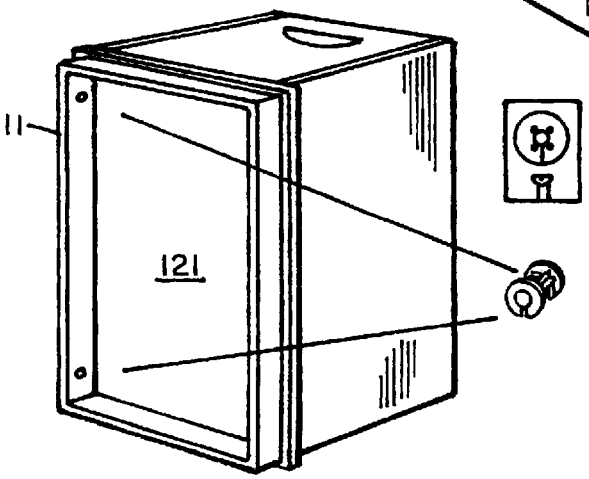
FIG. 7 shows a third assembly step according to the present invention.

For simplicity, reference will now be made to a single style of stacking file, it being understood that the assembly steps described hereinafter are applicable to essentially all types of vertical and lateral files. The assembly begins by securing the lowermost drawer module 12*a* to the file base 11. As shown in FIG. 5, the lowermost file box 12*a* is laid on its back with the drawer front facing up. Four locking screws are inserted into holes provided on the bottom of the drawer as shown. Then, as shown in FIG. 6, the locking screws are aligned with holes provided on the file base 11 and the base is pushed onto the screws until it is flush with the bottom of the file box. Four locking nuts are then inserted to holes located on the inside of the file base 11, as shown in FIG. 7. These holes are located proximate the location of the screws that connect the base to the lower drawer module 12*a*. The locking nut and locking screws are of the type conventionally known in the art and may include an arrow or some other visual indicator on the locking nut to help the user position the locking nut so that the nuts and screws are locked securely in place when the user turns the nuts approximately one half turn.

After the base is secured to the lower drawer module 12*a*, the user lays the unit right side up on the floor and pulls the drawer 123 out until it is fully extended. By pushing down on the locking mechanism on the drawer suspension on both sides, the user can remove the drawer 123 from the file box 12*a*. This step is repeated with the upper drawer module 12*b* and any other drawer modules to be added.

Figure 9:
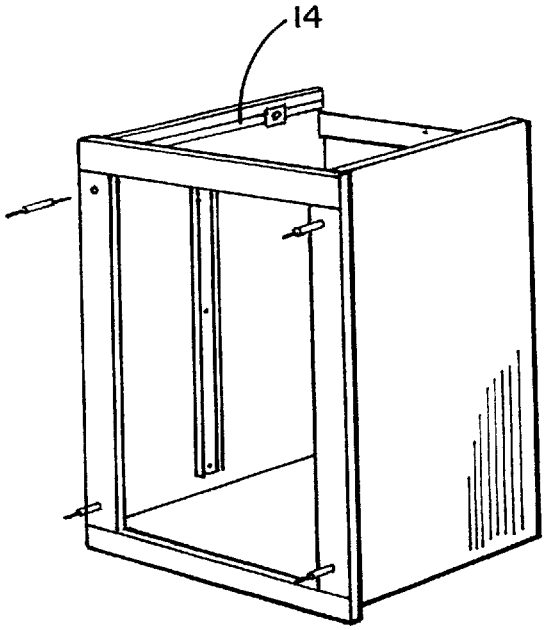
FIG. 9 shows a fifth assembly step according to the present invention.
Figure 10:
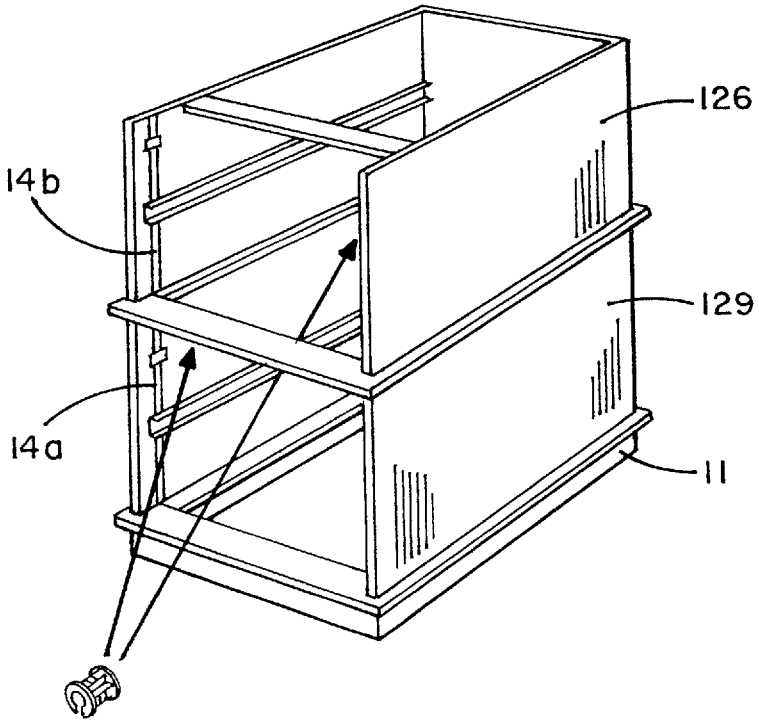
FIG. 10 shows a sixth assembly step according to the present invention.

Next, as shown in FIG. 9, the user places the second file box on its back and inserts four locking screws into holes located on the bottom of the box. Referring to FIG. 10, the second unit 12*b* is then aligned with the first unit 12*a* so that the locking screws extending from the bottom of the upper drawer of the second drawer module 12*b* are aligned with the holes provided on the top edges of the first drawer module 12*a*. The second drawer module 12*b* is pressed into the first drawer module 12*a* until it is flush with the lower unit 12*a*. Then, as previously described, locking nuts are placed in the four corresponding holes inside the top edge of the lower drawer module 12*a* and rotated about one half turn to secure the second drawer module 12*b* to the first drawer module 12*a*.

Each drawer module 12*a*, 12*b* includes a locking bar portion 14 such that when the first and second drawer modules 12*a*, 12*b* are connected as shown in FIG. 10, the respective locking bar portions 14 are vertically aligned. However, since the drawer modules 12*a*, 12*b* are, in the original condition, entirely separate and distinct from one another, the locking bar portions 14 are not connected to one another. As previously explained, the locking bar assembly must operate as a integrated unit to work properly. Thus, it has been recognized that there is a need to connect the respective locking bar portions 14 of the drawer modules 12*a*, 12*b*. In the past this has caused a great deal of difficulty.

Figure 11:
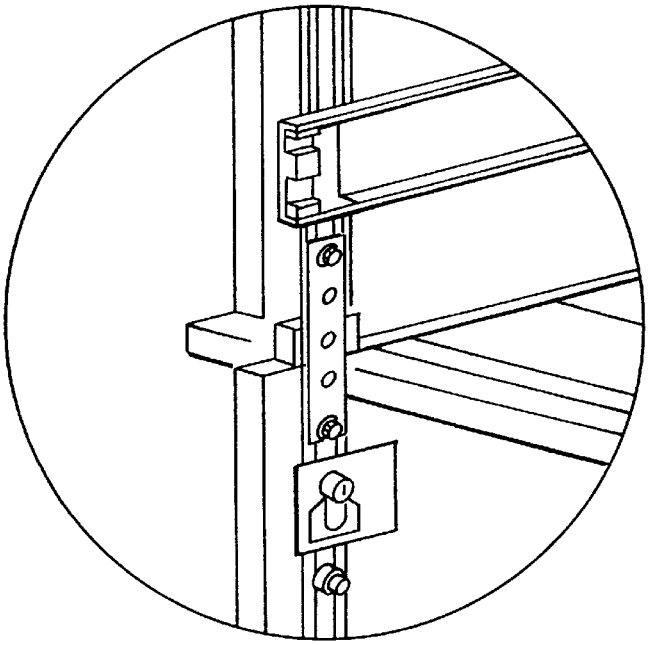
FIG. 11 PRIOR ART
FIG. 11 shows a prior art assembly step for connecting lock bar portions of adjacent modular drawer units.
Figure 11A:
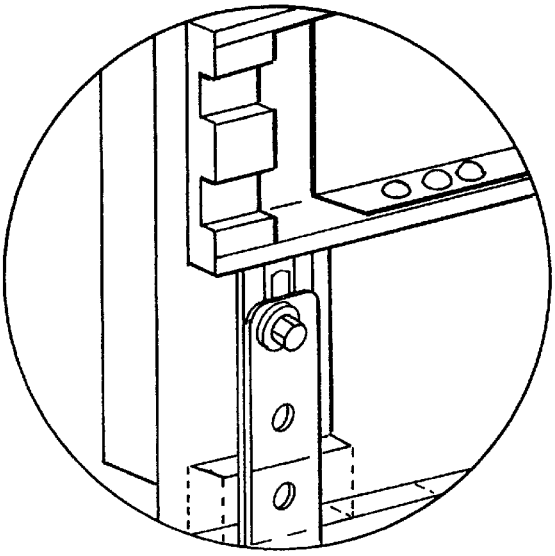
FIG. 11A PRIOR ART
FIG. 11A is another perspective view showing the prior art splicer arrangement unlocked position.
Figure 11B:
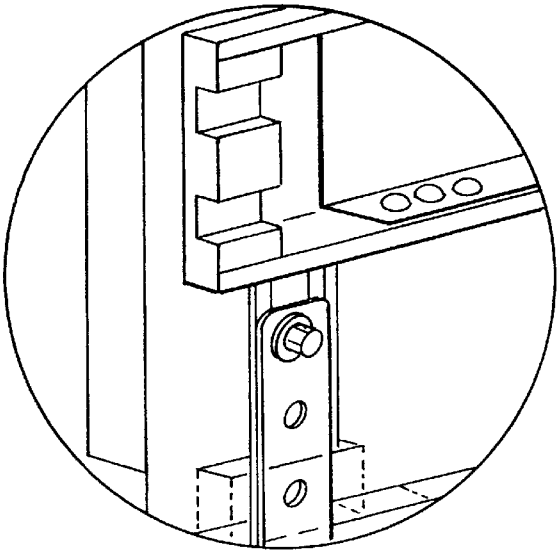
FIG. 11B PRIOR ART
FIG. 11B is yet another perspective view showing the prior art splicer bar arrangement in locked position.

FIGS. 11A–11B illustrate one known method of securing the respective lock bar portions to one another. This involves use of a splicer. According to this known method, the user is instructed to find the lock bars located on the left interior of each unit. The user is then told to make sure that the bar units are in the correct position. The user must then align the splicer clips with the lock bars, which is difficult because the splicer clips will not fit into the bars exactly until the nuts are tightened. The clips start out in the vertical position and then will tighten when the nuts disappear within the lock bar. Users are cautioned not to become discouraged because of the difficulty in performing this step.

Then, as shown in FIG. 11A and 11B, the user loosens the nuts until they are halfway undone. The splicer and its clip are then aligned with the lock part. The splicer is then slid down about an inch so that the enclosed hole in the center cannot be seen. The user then holds the splicer in place and tightens both the upper and lower nuts with the quarter-inch socket wrench with pliers until both clips disappear.

Even experienced professionals find that the known splicer connection method is awkward and difficult. As mentioned previously, it is believed that this way of connecting these elements is the most difficult step in the assembly of the stacking vertical file and it is a significant potential obstacle to commercial acceptance of the modular stacking file concept.

Recognizing this, the present inventor has designed an improved way of connecting the respective lock bar portions of adjacent drawer modules.

Figure 12:
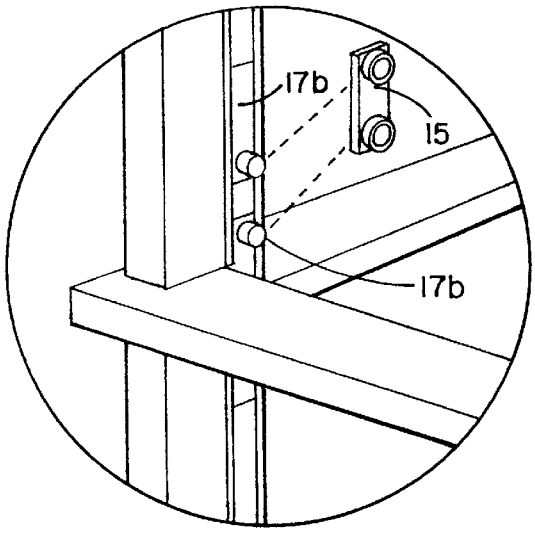
FIG. 12 is a perspective view showing the seventh assembly step according to the present invention using a connector plate.
Figure 12A:
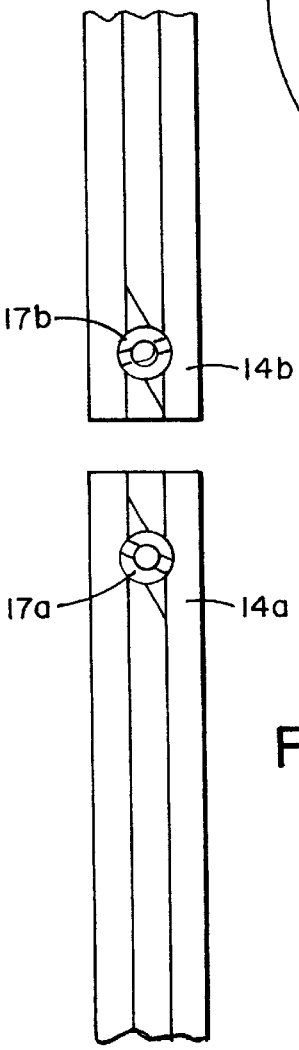
FIG. 12A is a plan view of two aligned locking bar portions that include transverse studs.
Figure 12C:
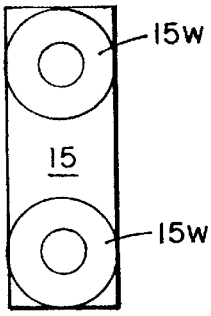
FIG. 12C view of a connector plate according to the present invention.
Figure 12D:
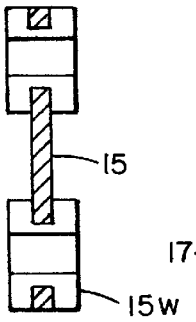
FIG. 12D is a plan view of the connector plate of FIG. 12C.
Figure 12E:
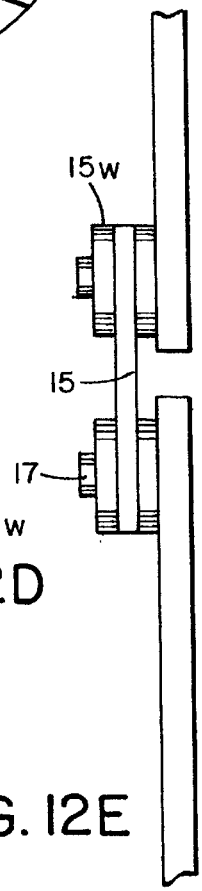
FIG. 12E is a side view of the locking bar assembly of the present invention including two locking bar portions connected by a connector plate.
Figure 12F:
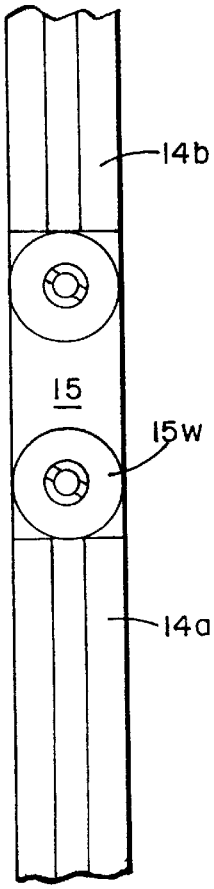
FIG. 12F is a plan view of the locking bar assembly of the present invention including two locking bar portions connected by a connector plate.
Figure 12B:
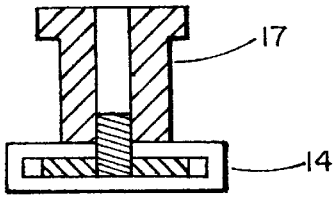
FIG. 12B is an enlarged sectional view of the stud and locking bar portion of FIG. 12A.

Specifically, as shown in FIG. 12, the present inventor uses a specially designed connector 15 that, in the embodiment shown, comprises a rectangular metal plate having two spaced stud receiving holes. Each of the locking bar portions includes a transverse stud 17*a*, 17*b*. Preferably, the studs 17*a*, 17*b* are either slidable relative to the lock bar potion or secured to an element that is slidable, as shown in FIG. 12. The studs 17 also preferably include an expanded head portion as shown in FIG. 12B to ensure a tight, no lash fit with the connector plate 15.

The details of the connector plate 15, studs 17*a*, 17*b* and locking bar portions 14*a*, 14*b* are shown in FIGS. 12A–12F. As shown therein, a compressible rubber washer 15*w* is located in each of these stud receiving holes of the connecting plate 15 to ensure a tight no-lash fit with the studs 17. As such, the connector 15 comprises a connector with two longitudinally spaced openings that are lined with a compressible material. The openings in the washers are slightly smaller than the expanded head of the studs so that the elastomer compresses when the connector plate is fit onto the stud. Thus, as shown in FIG. 12, the user need only locate the sliding stud portion of the lock bar above the top and bottom drawer modules 12*a*, 12*b*. The user slides these two portions together and holds them in place while pressing the connector plate 15 down over the studs on the lock bar. Because of the elastomeric nature of the rubber washers 15*w*, the connector fits snugly and flush over the studs to securely connect the respective lock bar portions without any looseness (lash). This step is repeated for each of the drawer modules.

Figure 13:
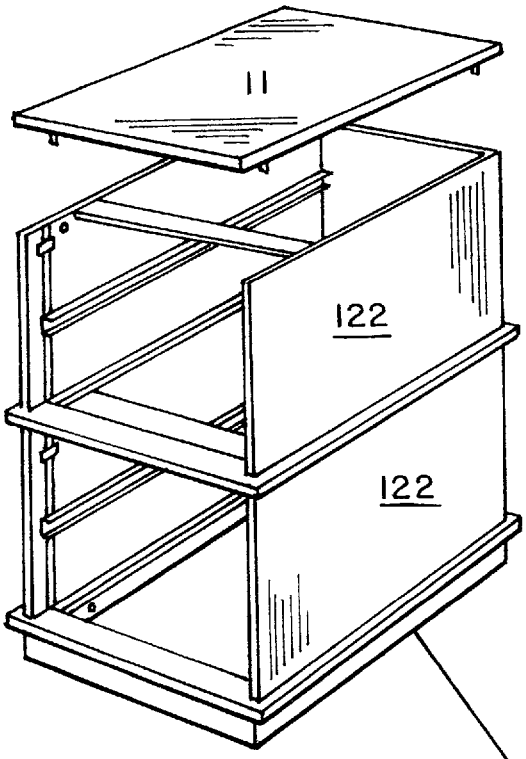
FIG. 13 is a perspective view showing an eighth assembly step according to the present invention.
Figure 14:
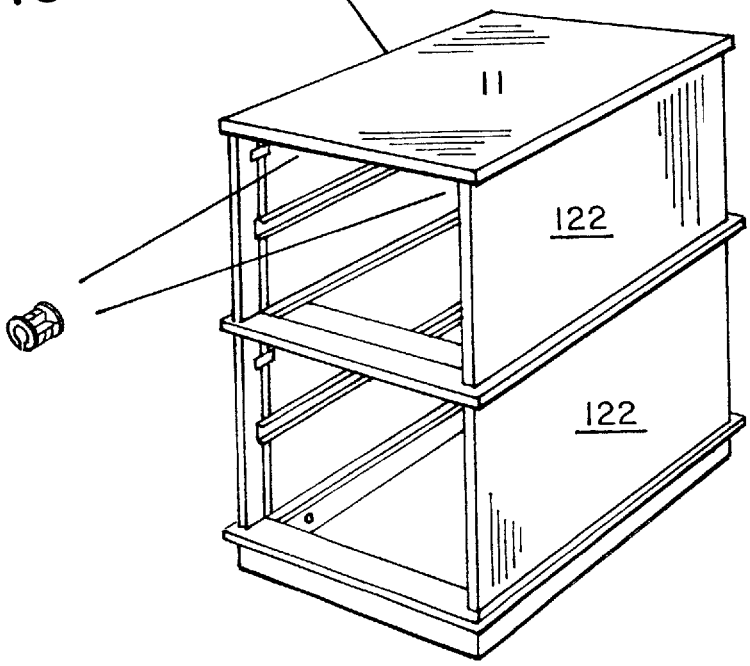
FIG. 14 a perspective view showing a ninth assembly step according to the present invention.

Once all the drawer modules have been attached, the top panel 13 is secured to the uppermost drawer module 12*b*. As shown in FIG. 13, the file top locking screws are inserted into the file top and then the file top is lowered onto the uppermost drawer module 12*b* so the locking screws align with holes provided in the top edges of the uppermost drawer module 12*b*. Then, as shown in FIG. 14, locking screws are aligned with holes provided in the upper drawer module 12*b* and locked into place to secure the locking screws and thus secure the top panel 13 to the uppermost drawer module 12*b*.

From the foregoing, it can be seen that the present invention provides a simple, easy to assemble modular stacking lateral or vertical file and overcomes the problems with known constructions by simplifying the step of connecting the locking bar portions 14 to a single integrated locking bar unit.

While in accordance with the Patent Statutes, the preferred forms and embodiments of the invention have been illustrated and described, it will be apparent to those skilled in the art that other changes and modifications may be made without deviating from the inventive concepts set forth above.

I claim:

1. A modular stacking file comprising:

a first drawer module comprising a cabinet portion and at least one drawer, said drawer being selectively slidable relative to the cabinet portion between an open position and a closed position, the first drawer module further comprising a lock bar portion having at least one transverse protrusion and means for mounting the lock bar portion to the cabinet portion for translatory movement relative to the cabinet portion in first and second opposite directions between first and second positions;

a second drawer module comprising a cabinet portion and at least one drawer, said drawer being selectively slidable relative to the cabinet portion between an open position and a closed position, the second drawer module further comprising a lock bar portion having at least one transverse protrusion and means for mounting the lock bar portion to the cabinet portion for translatory movement relative to the cabinet portion in first and second opposite directions between first and second positions;

means for aligning and connecting the first and second drawer modules such that the lock bar portion of the first drawer module is aligned with the lock bar portion of the second drawer module;

a connecting plate having two openings, each opening adapted to receive one of the protrusions formed on the lock bar portion so that the connecting plate can be secured to both the lock bar portion of the first drawer module and the lock bar portion of the second drawer module so as to join the respective lock bar portions as a single unitary lock bar assembly that moves as one piece; and wherein the connecting plate has two longitudinally spaced openings, each opening including an elastomeric inner surface having a dimension that is less than the dimension of the protrusion.

2. The modular stacking file, of claim 1, wherein the vertical stacking file has top and base and each module can be connected to either top or base.

3. The modular stacking file, of claim 1, wherein the protrusions are separate studs releasably secured proximate an end of the lock bar portion, each of the studs having a predetermined outer dimension.

4. The modular stacking file, of claim 3, wherein the studs include an expanded head portion having a predetermined outer dimension.

5. The modular stacking file, of claim 1, wherein the connecting plate has circular openings having a predetermined diameter that is greater than an outer dimension of the protrusion; the connecting plate further comprising rubber washers secured in the circular openings, each of the rubber washers having a protrusion receiving opening that has a predetermined diameter that is less than the outer dimension of the protrusion so that the washer must be compressed to receive the protrusion.

6. The modular stacking file, of claim 1, wherein the lock bar portion is formed of elongated flattened strap metal.

7. The modular stacking file of claim 1, wherein the connecting plate is adapted to snap on to the protrusions.

8. The modular stacking file, of claim 1, wherein the protrusion has an expanded head and reduced diameter portion below the head.

9. The modular stacking file, of claim 1, wherein protrusions are formed at each end of the lock bar portion to allow each module to be secured to another module at either end.

10. The modular stacking file, of claim 1, further comprising cooperating means on the lock bar assembly and the drawers of the first and second drawer modules for preventing simultaneous movement of drawers of the first and second drawer modules from their closed position to their open position.

11. The modular stacking file, of claim 1, wherein the cooperating means includes: interacting means on the lock bar portion and first drawer for moving the lock bar portion to the first position when the first drawer is moved from its closed position to its open position with the second drawer in its closed position; and interacting means on the lock bar portion and second drawer for moving the lock bar portion to the second position when the second drawer is moved from its closed position to its open position with the first drawer in its closed position.

12. The modular stacking file of claim 11, wherein the cooperating means comprises first and second lugs on the lock bar and first and second ramp plates on the first and second drawers respectively, each ramp plate having a ramp surface and a blocking surface, one of the lugs residing in the path of one of the ramp surfaces on one of the ramp plates upon one drawer carrying the one ramp plate being moved from its closed position towards its open position with the other drawer in its closed position and thereby causing the lock bar to be deflected into its first position wherein the other of the lugs blocks the blocking surface on the other of the ramp plates on the other drawer to prevent opening of the other drawer, the other lug residing in the path of the other ramp surface on the other ramp plate upon the other drawer being moved from its closed position towards it open position with the one drawer in the closed position and thereby causing the lock bar to be deflected into its second position wherein the one lug blocks the blocking surface on the one ramp plate to prevent opening of the one drawer.

13. In an article of furniture having a plurality of drawer modules, each drawer module including a reciprocative slide bar selectively movable between a drawer locked position and a drawer unlocked position, an improved system for connecting the reciprocative slide bars of adjacent drawer modules comprising: at least one transverse protrusion provided on each slide bar and a connecting plate having two openings, each opening adapted to receive one of the protrusions formed on the slide bar so that the connecting plate can be secured to the slide bars of the adjacent drawer modules so as to join the respective slide bars as a single unitary lock bar assembly that moves as one piece; and wherein each of the longitudinally spaced openings has an elastomeric inner surface having a dimension that is less than the dimension of the protrusion.

14. The system for connecting the reciprocative slide bars of adjacent drawer modules of claim 13, wherein the protrusions are separate studs releasably secured proximate an end of the lock bar portion, each of the studs having a predetermined outer dimension.

15. The system for connecting the reciprocative slide bars of adjacent drawer modules of claim 14, wherein the protrusions are studs located proximate an end of the slide bar, each of the studs having a predetermined outer dimension.

16. The system for connecting the reciprocative slide bars of adjacent drawer modules of claim 13, wherein the connecting plate has circular openings having a predetermined diameter that is greater than the outer dimension of the protrusion; the connecting plate further comprising rubber washers secured in the circular openings each of the rubber washers having a protrusion receiving opening that has a predetermined diameter that is less than the outer dimension of the protrusion so that the washer must be compressed to receive the protrusion.

17. The system for connecting the reciprocative slide bars of adjacent drawer modules of claim 13, wherein each protrusion has an expanded head and reduced diameter portion below the head.

18. The system for connecting the reciprocative slide bars of adjacent drawer modules of claim 13, wherein protrusions are formed at each end of the slide bar to allow each module to be secured to another module at either end.

19. A modular stacking file comprising:

a first drawer module comprising a cabinet portion and at least one drawer, said drawer being selectively slidable relative to the cabinet portion between an open position and a closed position, the first drawer module further comprising a lock bar portion having at least one transverse protrusion and means for mounting the lock bar portion to the cabinet portion for translatory movement relative to the cabinet in first and second opposite directions between first and second positions;

a second drawer module comprising a cabinet portion and at least one drawer, said drawer being selectively slidable relative to the cabinet portion between an open position and a closed position, the second drawer module further comprising a lock bar portion having at least one transverse protrusion and means for mounting the lock bar portion to the cabinet portion for translatory movement relative to the cabinet portion in first and second opposite directions between first and second positions;

means for aligning and connecting the first and second drawer modules such that the lock bar portion of the first drawer module is aligned with the lock bar portion of the second drawer module;

a connecting plate having two openings, each opening adapted to receive one of the protrusions formed on the lock bar portion so that the connecting plate can be secured to both the lock bar portion of the first drawer module and the lock bar portion of the second drawer module so as to join the respective lock bar portions as a single unitary lock bar assembly that moves as one piece; and wherein the connecting plate has circular openings having a predetermined diameter that is greater than an outer dimension of the protrusion; the connecting plate further comprising rubber washers secured in the circular openings, each of the rubber washers having a protrusion receiving opening that has a predetermined diameter that is less than the outer dimension of the protrusion so that the washer must be compressed to receive the protrusion.

20. A modular stacking file comprising:

a first drawer module comprising a cabinet portion and at least one drawer, said drawer being selectively slidable relative to the cabinet portion between an open position and a closed position, the first drawer module further comprising a lock bar portion having at least one transverse protrusion and means for mounting the lock bar portion to the cabinet portion for translatory movement relative to the cabinet portion in first and second opposite directions between first and second positions;

a second drawer module comprising a cabinet portion and at least one drawer, said drawer being selectively slidable relative to the cabinet portion between an open position and a closed position, the second drawer module further comprising a lock bar portion having at least one transverse protrusion and means for mounting the lock bar portion to the cabinet portion for translatory movement relative to the cabinet portion in first and second opposite directions between first and second positions;

means for aligning and connecting the first and second drawer modules such that the lock bar portion of the first drawer module is aligned with the lock bar portion of the second drawer module;

a connecting plate having two openings, each opening adapted to receive one of the protrusions formed on the lock bar portion so that the connecting plate can be secured to both the lock bar portion of the first drawer module and the lock bar portion of the second drawer module so as to join the respective lock bar portions as a single unitary lock bar assembly that moves as one piece; and wherein the cooperating means includes: interacting means on the lock bar portion and first drawer for moving the lock bar portion to the first position when the first drawer is moved from its closed position to its open position with the second drawer in its closed position; and interacting means on the lock bar portion and second drawer for moving the lock bar portion to the second position when the second drawer is moved from its closed position to its open position with the first drawer in its closed position.

21. In an article of furniture having a plurality of drawer modules, each drawer module including a reciprocative slide bar selectively movable between a drawer locked position and a drawer unlocked position, an improved system for connecting the reciprocative slide bars of adjacent drawer modules comprising: at least one transverse protrusion provided on each slide bar and a connecting plate having two openings, each opening adapted to receive one of the protrusions formed on the slide bar so that the connecting plate can be secured to the slide bars of the adjacent drawer modules so as to join the respective slide bars as a single unitary lock bar assembly that moves as one piece; and wherein the connecting plate has circular openings having a predetermined diameter that is greater than the outer dimension of the protrusion; the connecting plate further comprising rubber washers secured in the circular openings, each of the rubber washers having a protrusion receiving opening that has a predetermined diameter that is less than the outer dimension of the protrusion so that the washer must be compressed to receive the protrusion.

* * * * *